US009416786B2

(12) United States Patent
Welte et al.

(10) Patent No.: US 9,416,786 B2
(45) Date of Patent: Aug. 16, 2016

(54) ROTARY PUMP EXHIBITING AN ADJUSTABLE DELIVERY VOLUME, IN PARTICULAR FOR ADJUSTING A COOLANT PUMP

(71) Applicant: Schwäbische Hüttenwerke Automotive GmbH, Aalen-Wasseralfingen (DE)

(72) Inventors: Claus Welte, Aulendorf (DE); Uwe Meinig, Bad Saulgau (DE)

(73) Assignee: SCHWABISCHE HUTTENWERKE AUTOMOTIVE GMBH, Aalen-Wasseralfingen (DE)

( * ) Notice: Subject to any disclaimer, the term of this patent is extended or adjusted under 35 U.S.C. 154(b) by 438 days.

(21) Appl. No.: 13/966,366

(22) Filed: Aug. 14, 2013

(65) Prior Publication Data

US 2014/0050562 A1 Feb. 20, 2014

(51) Int. Cl.
*F04D 15/00* (2006.01)
*F04C 2/10* (2006.01)
(Continued)

(52) U.S. Cl.
CPC . *F04D 15/00* (2013.01); *F04C 2/10* (2013.01); *F04C 2/102* (2013.01); *F04C 15/0042* (2013.01); *F04D 5/002* (2013.01); *F04D 15/0038* (2013.01); *F05D 2270/64* (2013.01)

(58) Field of Classification Search
CPC ..... F04D 15/00; F04D 15/0038; F04D 5/002; F04C 2/102; F04C 15/0042; F04C 2/10
USPC ..... 415/126; 416/21, 69, 166, 171; 418/21, 418/69, 166, 171
See application file for complete search history.

(56) References Cited

U.S. PATENT DOCUMENTS 2,956,512 A * 10/1960 Brundage ..... F04C 2/102 418/132
3,034,447 A * 5/1962 Brundage ..... F01C 21/02 418/133

(Continued)

FOREIGN PATENT DOCUMENTS

DE 2754866 A1 6/1979
DE 44 44 704 A1 6/1996

(Continued)

OTHER PUBLICATIONS

European Patent Office Search Report issued in Patent Application No. EP 13 18 0155.7 dated Aug. 27, 2015.

*Primary Examiner* — Hoang Nguyen
(74) *Attorney, Agent, or Firm* — RatnerPrestia

(57) ABSTRACT

An adjustable delivery volume rotary pump, including: first and second housing structures; a delivery chamber comprising a first chamber wall formed by the first housing structure, a second chamber wall formed by the second housing structure, a fluid inlet in a low-pressure region and a fluid outlet in a high pressure region; a pump wheel rotatable about a rotational axis in the delivery chamber; and a pressing device for generating pressing force. The second housing structure can be moved relative to the first housing structure from a first to a second position, against the pressing force. In the second position, a gap exists between the first and the second chamber walls and fluid can escape from the delivery chamber by bypassing the inlet and the outlet, or a circulation of the fluid which reduces the delivery rate of the rotary pump arises in the gap within the delivery chamber.

26 Claims, 9 Drawing Sheets

(51) Int. Cl.
*F04C 15/00* (2006.01)
*F04D 5/00* (2006.01)

(56) References Cited

U.S. PATENT DOCUMENTS

| | | | | |
|---|---|---|---|---|
| 6,544,019 | B2 * | 4/2003 | Martin | F04C 15/0069 418/171 |
| 9,080,573 | B2 | 7/2015 | Welte et al. | |
| 2012/0204818 | A1 * | 8/2012 | Welte | F04D 15/0038 123/41.08 |

FOREIGN PATENT DOCUMENTS

| | | | |
|---|---|---|---|
| DE | 10 2008 049 204 | A1 | 4/2010 |
| DE | 10 2010 009 839 | A1 | 9/2011 |
| DE | 10 2011 012 826 | B3 | 1/2012 |
| DE | 10 2011 004 172 | B2 | 3/2012 |
| EP | 1 363 025 | A2 | 11/2003 |
| EP | 2 489 881 | A2 | 8/2012 |
| GB | 2 417 049 | A | 2/2006 |
| JP | 2001-214878 | | 8/2001 |
| WO | WO 2012/116676 | A1 | 9/2012 |

* cited by examiner

ROTARY PUMP EXHIBITING AN ADJUSTABLE DELIVERY VOLUME, IN PARTICULAR FOR ADJUSTING A COOLANT PUMP

CROSS REFERENCE TO RELATED APPLICATIONS

This applications claim priority to German Patent Application No. 10 2012 214 503.6, filed Aug. 14, 2012, the contents of such application being incorporated by reference herein.

FIELD OF THE INVENTION

The invention relates to a rotary pump which can be adjusted in terms of its delivery volume. The rotary pump can be part of a pump arrangement and can in particular serve as a servo pump for a working pump, in order for example to feed fluid to the working pump, i.e. to serve as its pre-loading pump, or to adjust an operational parameter of the working pump, for example its delivery volume. In combination with a working pump, it can form a coolant pump and serve to fluidically adjust the delivery volume of the working pump. One preferred area of application is in vehicle construction. The rotary pump or the combination of the rotary pump and the working pump can in particular be used to supply a unit, such as for example a combustion engine for driving a vehicle, with a fluid.

BACKGROUND OF THE INVENTION

Developments in internal combustion engines for motor vehicles focus on reducing exhaust emissions and fuel consumption. One approach for reducing fuel consumption and emissions is to adapt the operation of the various ancillary units, which for example include the coolant pump or lubricating oil pump, more precisely to the requirements of the engine. In the case of coolant pumps, which are a preferred use of the rotary pump, these efforts are aimed at more rapidly heating the engine following a cold start and at reducing the operational rate needed for the coolant pump, in particular at a high rotational speed of the engine. Mass-produced designs such as electrically driven coolant pumps and switchable friction roller drives make considering other alternatives seem worthwhile with regard to cost and reliability. The split ring slider represents an approach, which has been known for decades, for influencing the delivery characteristics of turbines as well as compressors and pumps having a radial design, wherein an annular slider which encompasses the feed wheel of the pump on the outer circumference is axially shifted, forming an annular gap, and the flow cross-section on the outer circumference of the feed wheel is thus varied. The annular slider acts as a shutter in the outflow region of the feed wheel.

The volume of fluid delivered by rotary pumps per unit time, referred to in the following as the delivery volume, changes with the rotational speed of the pump. In displacement-type rotary pumps, the delivery volume is proportional to the rotational speed of the pump, since such pumps exhibit a constant specific delivery volume, at least in the rotational speed range which is relevant for practical purposes. "Specific delivery volume" refers to the volume of fluid delivered per revolution. Fluid-flow machines such as for example centrifugal pumps do not have this proportionality; the delivery volume even increases disproportionally with respect to the rotational speed. If the rotary pump is rotary-driven by a combustion engine in a fixed rotational speed relationship to an output shaft of the combustion engine, for example a crankshaft, as is the case in preferred uses, the proportionality or in principle the dependency between the delivery volume and the rotational speed can be disruptive in particular rotational speed ranges of the combustion engine. Thus, for example, beyond a rotational speed of the engine of about 2000 rpm, lubricating oil pumps for supplying drive motors of motor vehicles deliver more lubricating oil than is required for lubricating the combustion engine. Coolant pumps, which in most applications are embodied as centrifugal pumps, show similar characteristics. If the respective pump delivers more fluid than is actually needed, energy for driving the pump is wasted. Undesirable side-effects can also occur. In the case of lubricating oil pumps, for example, delivering too much lubricating oil can cause the crankshaft to flounder in the lubricating oil, thus creating further losses. The delivered fluid which is surplus to requirement can for example be conveyed back into the fluid reservoir via a bypass, although this needlessly consumes drive energy for the pump.

In order to better adapt the delivery volume of rotary pumps to requirements, rotary pumps which can be adjusted, for example merely controlled or also regulated, in terms of delivery volume have been developed. Thus, for example, EP 1 363 025 B1, which is incorporated by reference, describes toothed wheel pumps which can be regulated. A vane cell pump which can be regulated is for example known from DE 10 2010 009 839 A1, which is incorporated by reference.

EP 2 489 881 A2, which is incorporated by reference, discloses a centrifugal pump which has a radial design and can be regulated, and its use as a coolant pump. The centrifugal pump comprises a radial feed wheel for delivering the working fluid, which can in particular serve as a coolant for a combustion engine, and also a servo pump for fluidically adjusting a setting structure which, when adjusted, alters the delivery volume of the centrifugal pump. The servo pump is embodied as a rotary pump and co-operates with a control valve via which the fluid delivered by the servo pump is applied to the setting structure. Above a lower rotational speed range, the delivery volume of the servo pump is high enough that the volume flow cannot flow quickly enough through the control valve when the valve is open, and a back-pressure can therefore be created which acts undesirably on the setting structure. In order to prevent this, a pressure limiter via which fluid can flow back into the cycle is provided downstream of the outlet of the servo pump. This corresponds to the bypass solution mentioned at the beginning.

SUMMARY OF THE INVENTION

It is an aspect of the invention to provide a rotary pump which can be adjusted in terms of its delivery volume but is nonetheless simple in its design and cheap, and which is also constructed to small dimensions and can therefore be arranged even in conditions of restricted space.

An aspect of the invention proceeds from a rotary pump which exhibits an adjustable delivery volume and comprises a housing including a first housing structure and a second housing structure and optionally one or more other housing structures, and also a delivery chamber and at least one pump wheel which can be rotated in the delivery chamber about a rotational axis. When it is rotary-driven, the pump wheel alone or optionally the pump wheel together with one or more other pump wheels delivers a fluid from an inlet, which leads into the delivery chamber, to an outlet which leads out of the delivery chamber. The inlet ports into a low-pressure region of the delivery chamber, and the outlet ports into a high-pressure region of the delivery chamber. The housing structures form chamber walls of the delivery chamber, the first housing structure forming a first chamber wall and the second housing structure forming a second chamber wall.

In accordance with an aspect of the invention, the second housing structure can be moved relative to the first housing structure from a first position into a second position, against a restoring pressing force. The rotary pump therefore also comprises a pressing device for generating the pressing force. In the second position, a gap exists between the first chamber wall and the second chamber wall and opens or opens further in the event of movement towards the second position. In first embodiments, the gap opens into an environment of the housing, such that in the second position, fluid can escape from the delivery chamber by bypassing the inlet and the outlet and at least some of the fluid flowing through the inlet into the delivery chamber is not even delivered as far as the outlet by means of the pump wheel but can rather flow off through the gap on the path between the inlet and the outlet. In second embodiments, the gap is an internal gap within the delivery chamber, such that fluid does not escape through the gap into the environment of the housing but is merely circulated in the delivery chamber. A lower delivery rate per unit time has to be applied for the part of the fluid which merely circulates in the delivery chamber than for the part of the fluid which flows through the delivery chamber and the outlet. The gap which is in this sense an internal gap thus circulates the fluid within the delivery chamber in a way which reduces the delivery rate. The internal gap can in particular be formed on an end-facing side of the pump wheel, by enlarging a gap—which exists between the pump wheel and the second chamber wall, even when the second housing structure is in the first position—through a movement towards the second position. If the second housing structure assumes the first position, the delivery chamber can advantageously be closed off in a seal, aside from the inlet and the outlet and unavoidable leaks, and the first position can correspondingly be a closing position of the second housing structure.

Unlike simple embodiments of known adjusting pumps, which channel delivered fluid which is surplus to requirement back into a reservoir via a bypass downstream of the outlet, this saves on the drive rate for the pump, since the rotary pump only has to deliver a comparatively low volume flow against the fluid pressure prevailing at the outlet, when the second housing structure is in the second position. A bypass valve for channelling away excess delivered fluid is not needed. The adjusting mechanism formed by means of the second housing structure and the pressing device can have a comparatively compact design exhibiting small dimensions, which makes it easier or even only then possible to arrange the rotary pump in restricted installation spaces.

The second chamber wall formed by the second housing structure can be a circumferential wall or a partial region of a circumferential wall of the delivery chamber. In preferred embodiments, the second chamber wall is an end-facing wall or a partial region of an end-facing wall of the delivery chamber. The second housing structure can advantageously be a housing cover which closes off the delivery chamber on one end-facing side.

The first housing structure can form a circumferential wall or a partial region of a circumferential wall of the delivery chamber. It preferably forms a circumferential wall and a base of the delivery chamber which axially faces the second chamber wall on the other side of the delivery chamber, i.e. another end-facing wall. A plurality of housing structures which are formed separately from each other, including the first housing structure, can also be joined to each other in order to surround the delivery chamber over its circumference and on one end-facing side. Said housing cover can also in principle be assembled from a plurality of housing structures which are formed separately from each other, including the second housing structure, i.e. the second housing structure can form a partial region of a housing cover only. In a housing cover assembled from a plurality of housing structures, the second housing structure can also be able to be moved relative to at least one of the other housing structures which form the assembled housing cover, in order to realise the mobility in accordance with the invention.

The second chamber wall can in particular extend in the low-pressure region of the delivery chamber, for example only in a chamber region which extends from the inlet towards the outlet but not as far as the outlet. In such embodiments, the second chamber wall also need not extend as far as the inlet, but can rather respectively exhibit a distance from both the outlet and the inlet in the rotational direction of the pump wheel and/or counter to the rotational direction. In preferred embodiments, however, the inlet ports into the delivery chamber in the region of the second chamber wall.

The second housing structure can in principle form the outlet of the delivery chamber; more preferably, however, it forms the inlet. The second chamber wall can then be an end-facing wall of the delivery chamber, and the inlet can port into the delivery chamber on this end-facing wall. The outlet can in particular port into the delivery chamber on another, axially opposite end-facing wall, or in principle also on a circumferential wall of the delivery chamber. The inlet can however also be formed by another housing structure, for example the first housing structure, such that the second housing structure forms neither the inlet nor the outlet.

The second housing structure can be supported or mounted, preferably on or by the first housing structure, such that it can be translationally or rotationally moved. An axial mobility, i.e. a mobility at least substantially parallel to the rotational axis of the pump wheel, can for example be considered as a translational mobility.

In preferred embodiments, the second housing structure is supported or mounted such that it can be tilted or pivoted. This reduces the danger of the second housing structure twisting and therefore jamming, as compared to a translational mobility. An ability to tilt and/or pivot can be simply and—not least for this reason—preferably realised by for example pressing the second housing structure in a loose pressure contact against a supporting structure, such as for example the first housing structure. The pressing force for this can expediently be generated by the pressing device. In such embodiments, the second housing structure can in particular be pressed into an axial pressure contact with the supporting structure, preferably the first housing structure. The second housing structure is tilted or pivoted away from the supporting structure, against the pressing force, by the fluid pressure acting in the delivery chamber, wherein however it remains local, on one side, in said pressure contact with the supporting structure.

In the case of a translational mobility, which can be realised instead of the ability to tilt, it is advantageous for reducing the danger of twisting if the pressing force is applied to the second housing structure in accordance with the pressure distribution in the delivery chamber. This can for example be realised by applying the pressing force eccentrically in the region of the force which acts on the second housing structure due to the pressure in the delivery chamber. If the second housing structure is able to tilt and is supported in a loose pressure contact, it is at least in principle unnecessary to take into account the pressure distribution in the interior of the delivery chamber. This also applies in principle in embodiments in which the second housing structure is mounted, such that it can be tilted, in a rotary bearing consisting of a shaft and a socket. In such embodiments, the rotary bearing merely determines the leverage which the pressure force which acts on the second housing structure in the delivery chamber has for rotary mounting. If the second housing structure is supported in a loose pressure contact, such that it can be tilted or pivoted, the tilting or pivoting axis need not at least necessarily be defined in advance. The pressing point through which the tilting or pivoting axis extends can be set in accordance with the pressure conditions in the delivery chamber. More preferably, however, the location of the tilting axis or at least a restricted region in which the tilting or pivoting axis extends is also predetermined by the design in such embodiments, for example by a guiding engagement in which the second housing structure is guided relative to the first housing structure, within the bounds of its mobility.

The pressing device is preferably embodied such that it presses the second housing structure in the axial direction against a supporting structure, wherein the supporting structure is preferably formed by the first housing structure, as already mentioned. If the second housing structure is able to tilt and/or pivot, a tilting or pivoting axis about which the second housing structure tilts or pivots relative to the first housing structure preferably extends transverse to the rotational axis of the pump wheel; expediently, it extends orthogonally with respect to the rotational axis in such embodiments.

In embodiments in which the second housing structure is supported or mounted such that it can be tilted or pivoted, a purely axial pressure contact with a supporting structure, preferably the first housing structure, is sufficient in order to define the tilting or pivoting axis precisely enough for practical requirements. In developments, the supporting structure—preferably, the first housing structure—and the second housing structure can jointly form a rotary mounting in the form of an open bearing socket and a bearing cam which is formed so as to fit the bearing socket. The bearing socket can thus for example comprise a cylindrical or spherical bearing area which advantageously extends over an angle of 180° or less around the tilting or pivoting axis thus formed. The bearing cam is formed so to be congruent with the bearing socket. The bearing socket can advantageously be formed on the supporting structure, but can also in principle be formed on the second housing structure instead. The bearing cam is correspondingly arranged on the other structure in each case and expediently formed with it in one piece. The bearing socket can in particular be formed in a shoulder which faces the second housing structure and is jointly formed by an end-facing area and an internal area of the supporting structure which faces the rotational axis, in the region of an internal angle of the end-facing area and the internal area, so to speak.

In particular in embodiments in which the second housing structure forms a housing cover and the second chamber wall is correspondingly an end-facing wall of the delivery chamber, it can be advantageous if the second housing structure is secured relative to the first housing structure against relative rotational movements about the rotational axis of the pump wheel. The second housing structure can in particular be arranged such that it cannot be moved in the circumferential direction relative to the first housing structure, by means of a guide which extends axially and preferably radially. The guide is however embodied such that it allows the movement into the first position which is required for adjusting the delivery volume. If the second housing structure can be tilted or pivoted, then the guide is arranged in the region of the tilting or pivoting axis or at least near to the tilting or pivoting axis in advantageous embodiments. The tilting or pivoting axis preferably extends through the guide.

The rotary pump can be embodied as a displacement pump or also as a fluid-flow machine such as for example a centrifugal pump. Internal-axle pumps, such as for example internal toothed wheel pumps and vane cell pumps, but also for example external toothed wheel pumps can be considered for the displacement pumps.

One particularly preferred type of pump is the side channel pump. In preferred embodiments, the rotary pump correspondingly comprises one or more side channel stages, i.e. one or more corresponding pump wheels. In preferred embodiments, the rotary pump is a single-stage pump. In embodiments as a side channel pump, the rotary pump comprises at least one pump wheel featuring pump wheel cells, for example an impeller, and axially—i.e. laterally—facing this pump wheel, at least one side channel which extends in the circumferential direction around the rotational axis of the pump wheel, axially alongside the pump wheel. If the side channel pump only comprises one side channel, this side channel is connected to the inlet of the rotary pump and, spaced in the circumferential direction, to the outlet of the rotary pump. A side channel can also be respectively provided laterally to the left and right of the at least one pump wheel. If the side channel pump is a multi-stage pump and comprises a first pump wheel and at least one other, second pump wheel, then only one side channel can be provided laterally facing the first pump wheel or a side channel can be provided on each of its two sides and only one side channel can be provided laterally facing the second pump wheel or a side channel can be provided on each of its two sides.

The pressing device can act mechanically, hydraulically, pneumatically or electrically. In preferred embodiments, the pressing force is an elastic restoring force, i.e. a spring force. In such embodiments, the pressing device correspondingly comprises one or more pneumatic or preferably one or more mechanical springs. If the pressing force is generated by one or more mechanical springs, the one or more springs can in particular act as pressure springs in terms of their load. The pressing force can however in principle be generated for example by one or more tension springs instead. In terms of its/their design, the one or more springs can each for example be a helical spring, a disc spring, a leaf spring or in particular a wave ring spring. The pressing device can also comprise a combination of differently designed springs. In preferred simple embodiments, in which the pressing device only comprises one spring and is preferably formed solely by such a spring, the spring is formed and arranged such that its spring axis coincides with the rotational axis of the pump wheel. If the pressing device comprises a plurality of springs, the plurality of springs are preferably arranged in a distribution around the rotational axis, and the spring axes extend parallel to the rotational axis.

The rotary pump can in particular be used as a servo pump in combination with a primary pump, referred to in the following as a working pump, for example for adjusting the delivery volume of the working pump. EP 2 489 881 A2 discloses a particularly favourable combination of a working pump, which can be adjusted in terms of its delivery volume, and a servo pump which is embodied as a rotary pump. The rotary pump in accordance with the invention can replace any of the rotary pumps disclosed in this senior application, in order to fluidically adjust the working pump in terms of its delivery volume. The working pump can advantageously be a coolant pump for a vehicle, in particular for a combustion engine of a vehicle or for the heater and/or cooler of a vehicle.

Reference is made to EP 2 489 881 A2 in terms of advantageous combinations of a working pump and servo rotary pumps.

The subject-matter of an aspect of the invention correspondingly includes a pump arrangement for supplying a unit, preferably a unit of a combustion engine, with a working fluid, wherein the pump arrangement comprises a working pump for conveying the working fluid towards or away from the unit, and a rotary pump in accordance with the invention. The working pump comprises: a working pump housing; a working pump wheel, which can be rotary-driven by a drive shaft, for conveying the working fluid; and a setting structure which can be adjusted into different positions relative to the working pump housing by means of a control fluid, in order to adjust a configuration of the working pump. The adjustable configuration of the working pump is preferably such that the configuration is decisive for the delivery volume of the working pump. If the working pump is embodied as an internal toothed wheel pump, the adjustable working pump configuration can in particular be the eccentricity which exists between an externally toothed internal wheel and an internally toothed external wheel; if the working pump is embodied as vane cell pump, the adjustable working pump configuration can in particular be the position of a setting ring which surrounds an impeller. If the working pump is embodied as a fluid-flow machine, for example as the working pump of EP 2 489 881 A2, the adjustable working pump configuration is preferably an adjustable flow geometry such as for example a flow cross-section or flow profile on a flow path of the working fluid, wherein this flow path comprises an inflow region of the working pump wheel, the working pump wheel itself, and an outflow region of the working pump wheel. Ways of adjusting the flow geometry for a fluid-flow machine having a radial design are illustrated in EP 2 489 881 A2.

Advantageous features are also described in the sub-claims and combinations of them.

BRIEF DESCRIPTION OF THE DRAWINGS

An example embodiment of the invention is described below on the basis of figures. Features disclosed by the example embodiment, each individually and in any combination of features, advantageously develop the subject-matter of the claims and also the embodiments described above. There is shown:

DETAILED DESCRIPTION OF THE INVENTION

Figure 1:
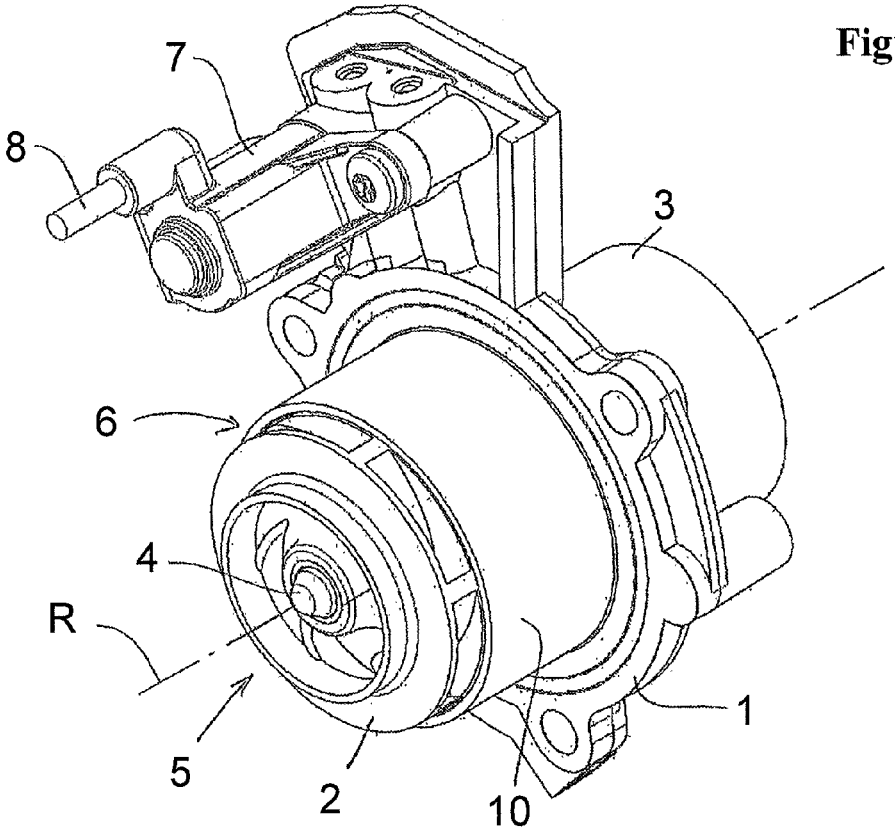
FIG. 1 a pump arrangement comprising a rotary pump which serves as a servo pump, in a first example embodiment.

FIG. 1 shows a pump arrangement of a first example embodiment, in a perspective view. The pump arrangement can be used as a coolant pump for a combustion engine, preferably as a coolant pump for an internal combustion engine of a motor vehicle, and is referred to as a whole in the following as the coolant pump. It is a coolant pump having a radial design.

In a housing 1 of the coolant pump, a radial feed wheel 2 is mounted such that it can be rotated about a rotational axis R. The housing 1 comprises assembly points for assembling it in the cooling cycle of the combustion engine and preferably to the combustion engine. When assembled, the coolant pump is coupled to the combustion engine in order to drive it, i.e. it can be rotary-driven by the combustion engine via a suitable transmission, for example a traction drive. A drive wheel 3 is correspondingly arranged on a drive side of the coolant pump, for example a belt pulley as is usual, which however could also be replaced with a sprocket in the case of a chain drive or with a toothed wheel for an optional toothed wheel drive instead of a traction drive. The drive wheel 3 is arranged coaxially with respect to the radial feed wheel 2 and can thus be rotated about the same rotational axis R. The radial feed wheel 2 is connected, fixedly in terms of torque, to the drive wheel 3. The two wheels 2 and 3 are for example respectively connected, secured against rotation, to a common drive shaft 4 which is rotary-mounted by the housing 1. When the pump is in operation, the radial feed wheel 2 delivers a coolant, preferably a liquid coolant, from a central inflow region 5—the suction side of the pump—into an outflow region 6 which extends around the radial feed wheel 2 on the outer circumference. The radial feed wheel 2 is connected on the suction side to a coolant reservoir via the inflow region 5 and on the pressure side to the combustion engine which is to be supplied with the coolant or to one or more other consumers, for example a heater, via the outflow region 6.

In order to be able to adapt the coolant flow delivered by the radial feed wheel 2 to the requirements of the combustion engine or another optional consumer, the coolant pump can be adjusted in terms of its delivery flow. The delivery flow is adjusted by varying the flow geometry, for example by varying the flow cross-section in the transition from the radial feed wheel 2 to the outflow region 6 which, as is known from radial pumps, is formed by an annular channel or partial annular channel of a removed part of the housing 1 not shown in FIG. 1. The annular channel or partial annular channel extends 360° completely around the radial feed wheel 2 on the outer circumference of the radial feed wheel 2 or at least partially around its circumference. A setting structure 10 which is formed as an annular slider, such as preferably a split ring slider, and can be axially adjusted back and forth into different adjusting positions relative to the housing 1 and the radial feed wheel 2 serves to vary the flow geometry. The setting structure 10 together with the radial feed wheel 2 directly forms an annular gap which encompasses the radial feed wheel 2, i.e. it acts as a split ring slider. The setting structure 10 can be adjusted back and forth between a first axial adjusting position and a second axial adjusting position. In FIG. 1, it assumes the first adjusting position in which the transition cross-section from the radial feed wheel 2 to the outflow region 6 is at a maximum. In the second adjusting position, this transition cross-section is at a minimum. In the first adjusting position, the setting structure 10 for example releases the radial feed wheel 2 over its entire effective axial delivery width. In the second adjusting position, it overlaps the effective delivery width of the radial feed wheel 2—as is preferred, but merely by way of example—completely. By means of the setting structure 10, it is therefore possible to adjust between a minimum delivery volume, which for example corresponds to a zero delivery, and a maximum delivery volume. The setting structure 10 can preferably be adjusted into any intermediate position between the first adjusting position and the second adjusting position and set to the desired adjusting position, i.e. held in position.

In order to be able to adjust the delivery volume automatically, the coolant pump comprises an actuator device featuring a control valve 7 which—as is preferred, but merely by way of example—is formed as an electromagnetically acting valve. Electrical energy and control signals can be fed to the control valve 7 via a port 8. The control valve 7 can in particular be connected via the port 8 to a controller of the combustion engine, for example an engine controller in the case of a drive motor of a motor vehicle, or a controller for a vehicle heater.

The setting structure 10 can be fluidically adjusted by means of a control fluid which is formed by the coolant to be delivered. For this purpose, the setting structure 10 is coupled in the housing 1 to a piston to which a pressure of the control fluid is applied, controlled by the control valve 7. A control signal can be fed to the control valve 7 via the port 8. The control signal can be generated as a function of a measured temperature, in particular a temperature measured in the cooling circuit, such as for example a coolant temperature. A temperature sensor can then be arranged at a representative point of the cooling circuit, preferably at each of a plurality of representative points, wherein the sensor output signal of the temperature sensor is fed to the controller which forms the control variable for the control valve 7 from the sensor signal or signals.

Figure 2:
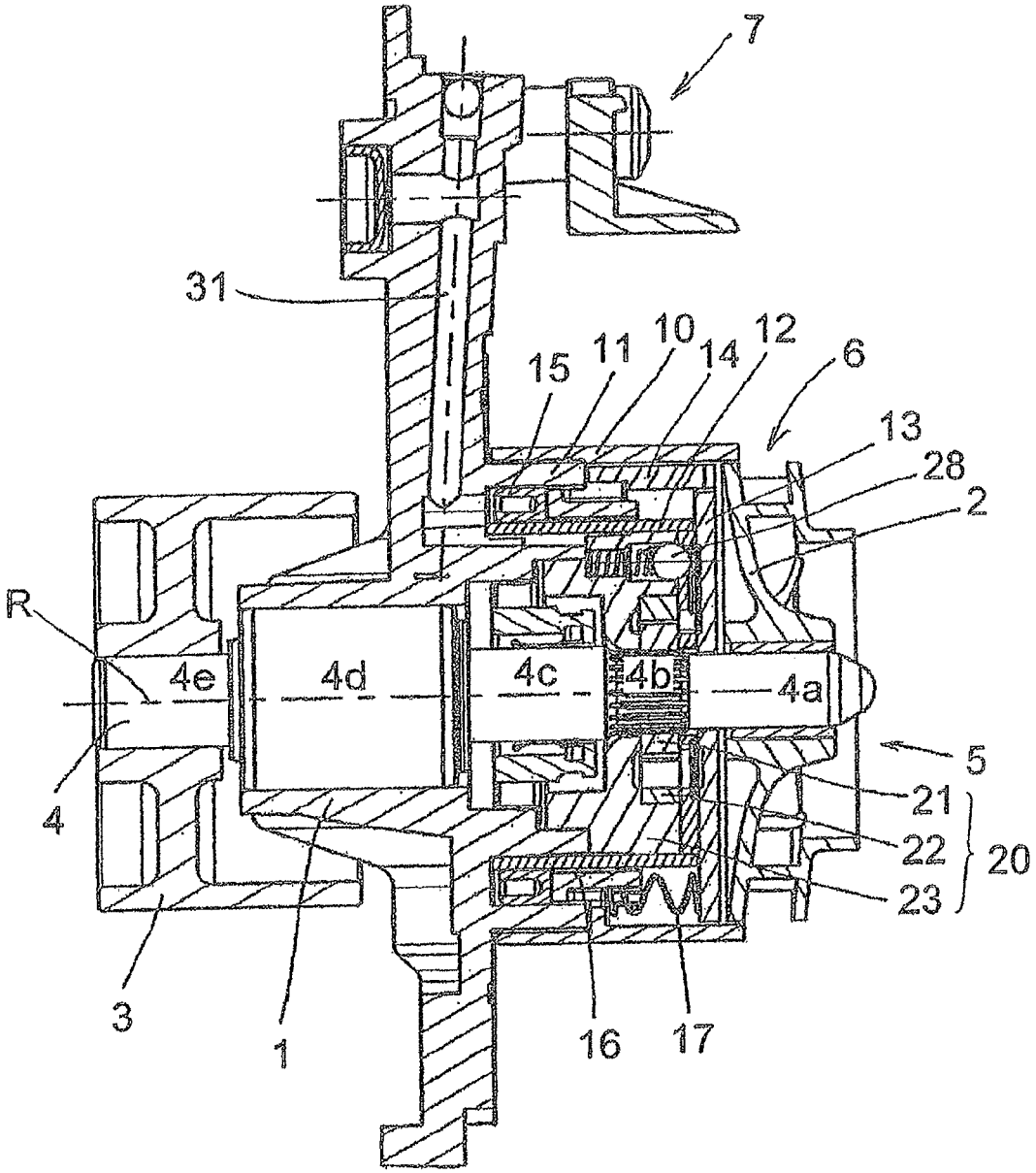
FIG. 2 the pump arrangement in a longitudinal section.

FIG. 2 shows the coolant pump in a longitudinal section. The drive shaft 4 is sub-divided into functional axial portions 4*a* to 4*e* in the representation and is rotationally mounted in and by the housing 1 in the shaft portion 4*d* by means of a roll bearing. The radial feed wheel 2 is connected, secured against rotation, to the drive shaft 4 in a front end portion 4*a*. The drive wheel 3 is arranged in a rear shaft portion 4*e* which faces axially away from the shaft portion 4*a*, behind the rotary bearing portion 4*d* as viewed from the radial feed wheel 2, where it is connected, secured against rotation, to the shaft 4. Because the shaft 4 is rotary-mounted in a shaft portion axially between the support for the radial feed wheel 2 and the support for the drive wheel 3, an axially short distance between the rotary mounting of the shaft 4 and the radial feed wheel 2 is maintained and a bending moment which may occur during delivery action and which is to be absorbed in the portion 4*d* of the rotational mounting of the drive shaft 4 is reduced.

In order to generate the control fluid pressure required for adjusting the setting structure 10, the coolant pump comprises an additional pump 20 which is referred to in the following as the servo pump 20 in order to distinguish it conceptually from the working pump which comprises the radial feed wheel 2, which is the actual coolant pump. The servo pump 20 is a displacement-type rotary pump and is for example embodied as an internal toothed wheel pump. It comprises an internal wheel 21 which is connected, secured against rotation, to the shaft 4 and provided with an external toothing, and an internally toothed external wheel 22 which surrounds the internal wheel 21, which are in a delivery engagement, i.e. a toothed engagement, with each other in which they periodically form delivery cells which increase in size and decrease in size again circumferentially around the rotational axis R when the shaft 4 is rotary-driven. The control fluid—in this case, the coolant—is suctioned by the delivery cells which increase in size, in the region in which the cells increase in size, i.e. the low-pressure side of the servo pump 20. The control fluid is expelled again at an increased pressure in the region in which the cells decrease in size, i.e. the high-pressure side of the servo pump 20. The servo pump 20 is connected to the control valve 7 on its high-pressure side via a pressure channel 31.

The control fluid region which extends from the exit of the servo pump 20 as far as the control valve 7, i.e. which includes the pressure channel 31, forms the high-pressure side of the servo pump 20. The pressure of the control fluid on the high-pressure side is set using the control valve 7. On this high-pressure side, the control fluid acts on a piston 15 which is guided such that it can be axially moved in the housing 1 of the coolant pump and is coupled to the setting structure 10 such that the setting structure 10 is shifted towards the adjusting position which exhibits the maximum axial overlap of the radial feed wheel 2 when a corresponding control fluid pressure is applied to the piston 15. The piston 15 is connected, axially fixed, to the setting structure 10—as is preferred—such that the setting structure 10 simply participates in the axial movement of the piston 15. A spring force is applied to the setting structure 10 in the opposite axial direction by a spring device comprising springs 17 which are arranged in a uniform distribution around the rotational axis R. The spring force thus acts counter to the control fluid pressure acting on the piston 15, restoring the setting structure 10 towards the minimum-overlap adjusting position which it assumes in FIG. 2.

The control valve 7 can for example be a manifold valve which can be switched between different switching positions and blocks off the high-pressure side of the servo pump 20 in a first switching position and short-circuits the high-pressure side of the servo pump 20 to the coolant circuit in a second switching position and preferably connects it to the pressure side of the coolant pump for this purpose. The servo pump 20 is expediently configured such that even when the combustion engine is idling, the control fluid pressure generated by the servo pump 20 is sufficient to adjust the setting structure 10 into the maximum-overlap adjusting position when the control valve 7 is situated in the first switching position, i.e. the blocking position. If, as is preferred, the maximum-overlap adjusting position corresponds to a complete overlap, the radial feed wheel 2 delivers practically no coolant. This enables the combustion engine to be heated quickly when it is started from cold. The power consumption of the coolant pump is also reduced.

If another unit—for example a motor vehicle heater, if the combustion engine is the drive motor of a vehicle—is also to be supplied with the coolant delivered by the radial feed wheel 2, a diversion to such an additional unit can be arranged downstream of the feed wheel 2, and another control valve can be provided in order to optionally channel the coolant to the combustion engine or to the other unit, which also includes the scenario in which the coolant can be channelled to both the combustion engine and the other unit simultaneously via such a control valve. In accordance with the requirements of an optional additional unit, it can therefore also be advantageous if the setting structure 10 does not axially overlap the radial feed wheel 2 completely on the outer circumference in the maximum-overlap adjusting position but rather only over an axial partial portion.

In simple embodiments, the control valve 7 can exhibit in total only the two switching positions mentioned and also always assume one of these switching positions. In such simple embodiments, the setting structure 10 can be triggered such that the setting structure 10 can only assume one of the two extreme positions, respectively, i.e. either the maximum-overlap adjusting position or the minimum-overlap adjusting position. In one development, the control valve 7 can be configured to switch back and forth between the two switching positions quickly enough that the setting structure 10 can also be set to any adjusting position axially between the two extreme positions. In yet other developments, the control valve 7 can be configured to set the pressure of the control fluid continuously to a particular value and so set the setting structure 10 to a particular position or to any desired position between the maximum-overlap adjusting position and the minimum-overlap adjusting position, in accordance with the equilibrium of force between the control fluid pressure and the restoring spring force.

A pressure holding device 28, which prevents the control fluid from being able to flow back into the servo pump 20, is arranged between the servo pump 20 and the control valve 7. In a blocking position, the pressure holding device 28 blocks a flow cross-section against a backflow to the servo pump 20 but allows an outward flow towards the control valve 7. It only opens when the pressure of the control fluid at an upstream inlet of the pressure holding device 28 near to the servo pump 20 exceeds the pressure of the control fluid at a downstream outlet of the pressure holding device 28 near to the control valve 7. A spring force into the blocking position is applied to the pressure holding device 28, i.e. it assumes the blocking position at equal pressure. The spring force acting in the blocking position is set such that the pressure holding device 28 opens towards the control valve 7 at least when the combustion engine is idling and the pressure acting on the piston 15 corresponds to the ambient pressure. The pressure holding device 28 is embodied—as is preferred, but merely by way of example—as a reflux valve.

When the control valve 7 is blocking, it is possible due to the pressure holding device 28 for the setting structure 10 to be held in the maximum-overlap adjusting position for a comparatively long period of time after the combustion engine has been switched off, since the control fluid is prevented from flowing back via the servo pump 20. If, as is preferred, the setting structure 10 closes and largely seals the transition cross-section on the outer circumference of the radial feed wheel 2 in this adjusting position, the coolant can be held back upstream of the radial feed wheel 2 for longer—in accordance with the strength of seal on the transition cross-section—than would be the case if the pressure were quickly relieved on the high-pressure side of the servo pump 20. The combustion engine can cool down more slowly after it has been switched off, and the cooling process can be consolidated.

The servo pump 20 and the pressure holding device 28, if the latter is provided, are preferably configured such that the pressure generated by the servo pump 20 when the combustion engine is idling is sufficient to adjust the setting structure 10 into the maximum-overlap adjusting position. By correspondingly triggering the control valve 7, this pressure can be either maintained or reduced and the position of the setting structure 10 can thus be set in accordance with requirements, even when the combustion engine is idling. This preferably also applies to any other operational state of the combustion engine, as long as the control fluid pressure generated by the servo pump 20 is sufficient to overcome the restoring spring force which acts on the setting structure 10 towards the minimum-overlap position.

Figure 4:
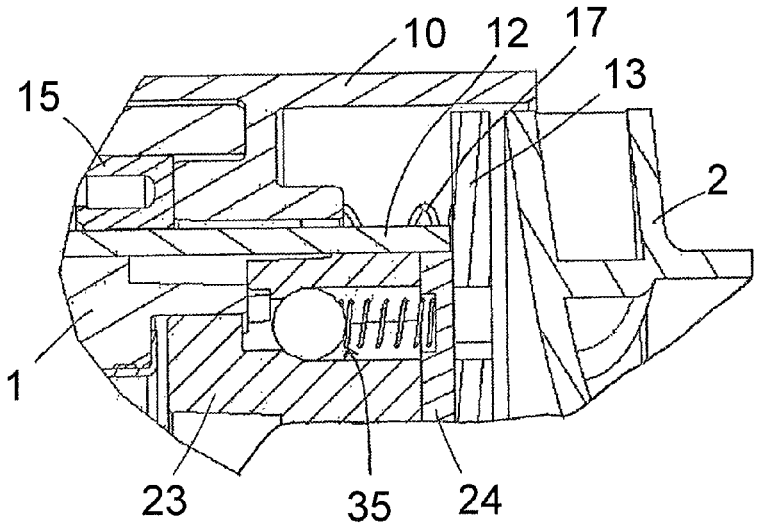
FIG. 4 an optional pressure limiter of the pump arrangement.

The control fluid pressure can be limited to a maximum value by means of an optional pressure limiter 35 which is shown in FIG. 4, such that the control fluid pressure cannot exceed this value even at high rotational speeds and a correspondingly high delivery volume of the servo pump 20. Limiting the control fluid pressure limits the force with which the setting structure 10 can press against an axial abutment in the maximum-overlap adjusting position to a maximum value which follows from the control fluid pressure and the effective pressure area of the piston 15. An inlet of the pressure limiter 35 is connected to the space in which the control fluid is applied to the piston 15. An outlet of the pressure limiter 35 channels the control fluid back into the main flow of the coolant which is delivered by the radial feed wheel 2. The pressure limiter 35 is formed—as is preferred, but merely by way of example—as a reflux valve. The pressure limiter 35 is arranged offset with respect to the pressure holding device 28 in the circumferential direction around the rotational axis R. The longitudinal section shown in FIG. 4 is correspondingly offset in the circumferential direction with respect to the longitudinal section of FIGS. 2 and 3.

The servo pump wheels 21 and 22 are accommodated in a servo pump housing of their own which comprises a first housing structure 23 and a second housing structure 24. The housing structure 23 rotatably mounts the external wheel 22 over its outer circumference in a sliding contact. Accommodating the servo pump wheels 21 and 22 in their own servo pump housing 23, 24 facilitates assembling the pump arrangement, in that a pre-assembled servo pump 20 can be installed. The servo pump housing 23, 24 is arranged in the housing 1 of the working pump and/or coolant pump, a s is preferred, within the annular setting structure 10. The pressure holding device 28 and the pressure limiter 35 are likewise arranged in the servo pump housing 23, 24.

Figure 3:
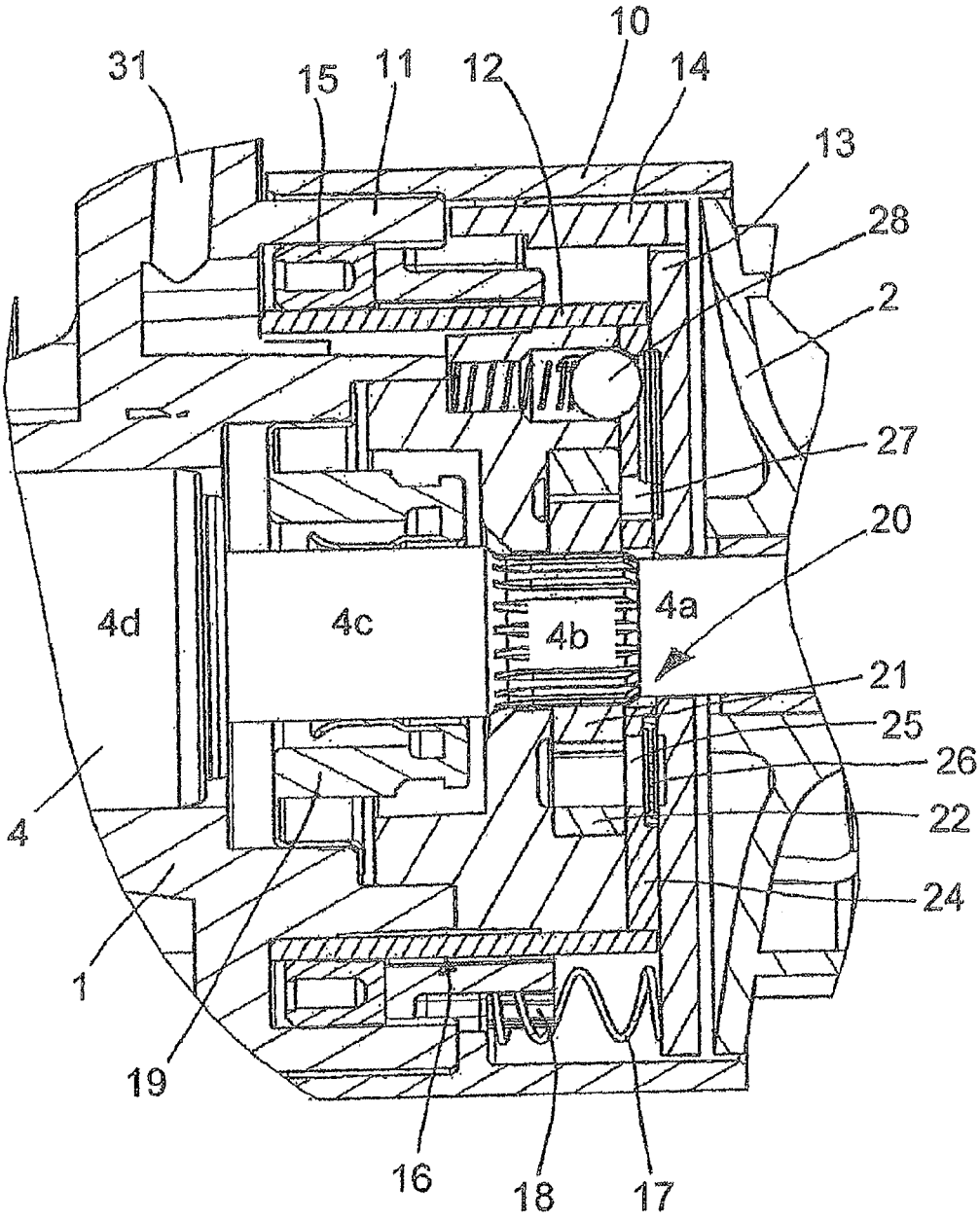
FIG. 3 a central region of the pump arrangement, in a longitudinal section.

FIG. 3 shows an enlarged representation of the central region of the coolant pump, in the same longitudinal section as FIG. 2. The centrally arranged servo pump housing 23, 24 is covered by a supporting structure 13 on its end-facing side which faces the radial feed wheel 2. The supporting structure 13 also simultaneously covers the housing 1 of the coolant pump on the side in question. The housing structure 24 is arranged axially between the servo pump housing 23, 24 and the supporting structure 13 and directly overlaps the housing structure 23, wherein the inlet 25 and the outlet 27 of the servo pump 20 are formed in the housing structure 24. A filter 26, for example a filter sieve, which holds back dirt particles is arranged in the inlet 25 in the housing structure 24. When the drive shaft 4 rotates, the servo pump 20 suctions coolant in through the inlet 25 from a point within the centrifugal force field, for example on or near to the outer circumference of the radial feed wheel 2, or through one or more perforations in the radial feed wheel 2, and expels the coolant at an increased pressure through the outlet 27 as a control fluid. The outlet 27 is connected to the pressure channel 31 via the pressure holding device 28, and the pressure channel 31 is connected to the rear side of the piston 15 which faces away from the radial feed wheel 2. The pressure holding device 28 assumes the blocking position in FIG. 3. The servo pump 20 is at a stop, or if the control valve 7 is blocking, the pump speed has for example just been reduced.

The servo pump 20 is arranged in the shaft portion **4*b* which is axially connected to the shaft portion 4*a*. A shaft seal 19, for example in the form of a sliding ring seal or a lip seal, which seals off the housing 1 is arranged in the shaft portion 4***c* between the housing structure 23 and the shaft portion 4*d* which forms the rotary mounting. As can also be seen not least from FIG. 3, the servo pump 20 which is embodied as a rotary pump is advantageously axially narrow, which enables the radial feed wheel 2 to be axially arranged particularly near to the rotary mounting formed in the shaft portion 4*d*. Because of the embodiment as an internal toothed wheel pump, this axial distance can be kept particularly small.

The setting structure 10 is axially guided along a guide 12 in a sliding guide contact. The guide 12 is a sleeve which is inserted into the housing 1 and is—as is preferred, but merely by way of example—a steel sleeve. The guide 12 surrounds the servo pump housing 23, 24 and is for example slid directly over the servo pump housing 23, 24. The guide 12 is thus supported inwards on the servo pump housing 23, 24. It is also supported on the housing 1 by also being slid, preferably pressed, in the housing 1 onto a free circumferential area of the housing 1. The housing 1 is preferably produced from an aluminium material and can in particular be cast from aluminium or an aluminium-based alloy.

The setting structure 10 can in particular be a plastic structure, for example an injection-moulded part made of a thermoplast. The piston 15 is expediently formed from an elastomer or from natural rubber. The piston 15 is accommodated, such that it can be moved axially back and forth, in an annular cylinder space. The annular cylinder space is limited on the outside at 11 by an internal circumferential area of the housing 1 and on the inside by the guide 12. Limiting the annular cylinder space using metal areas is favourable to the respective tribological pairing with the piston 15. As already mentioned, the control fluid is applied to a free side of the piston 15. The piston 15 is arranged at an axial end of the setting structure 10, which faces away from the radial feed wheel 2 as is preferred, and can be connected to the setting structure 10, in particular fixedly, for example in a material fit. In principle, however, the piston 15 can also be in a pressure contact only with the setting structure 10 in the direction in which the control fluid is applied to it. As mentioned, a plurality of springs 17 which are arranged in a distribution around the rotational axis R act counter to the pressure of the control fluid and are respectively supported at one end on the lid 13 and at the other end on a spring seating 18 which is formed on the setting structure 10. The springs 17 are for example embodied as helical pressure springs. They are arranged in an annular space which is limited radially on the inside by the guide 12 and radially on the outside by the setting structure 10.

In its guide contact with the guide 12, the setting structure 10 is supported on the guide 12 by means of a stay mounting which is formed by axially extending stays 16. The stays 16 are formed on an internal circumference of the setting structure 10 which radially faces the guide 12.

Figure 5:
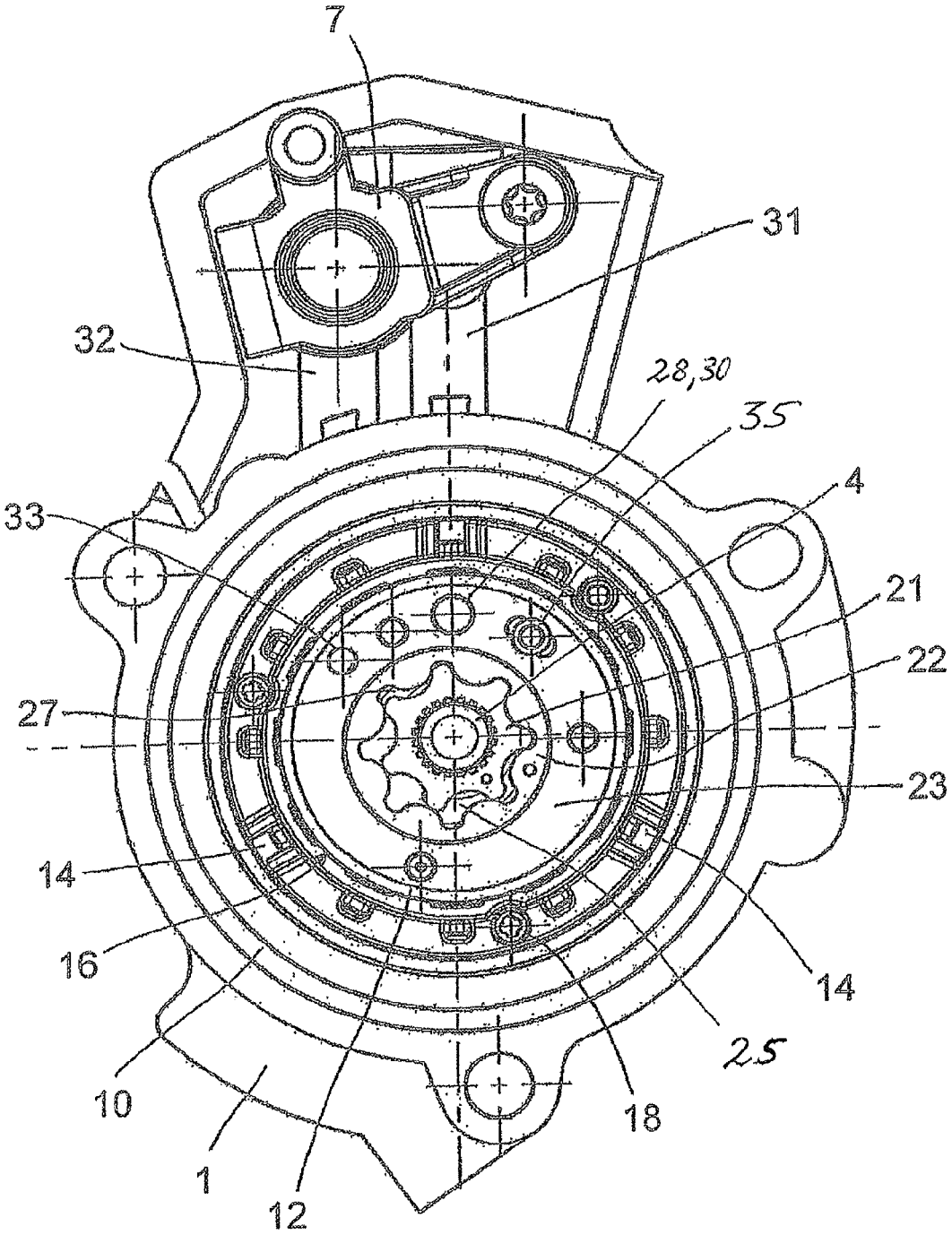
FIG. 5 the pump arrangement in a first cross-section.

FIG. 5 shows the coolant pump in a cross-section, axially level with the servo pump wheels 21 and 22. The shaft 4, the internal wheel 21 which is arranged, secured against rotation, on the shaft 4, the external wheel 22 which is in delivery engagement with the internal wheel 21, the servo pump housing 23, 24 and the guide 12 which surrounds the pump housing 23, 24 can be seen radially from the inside to the outside. The accommodating space which is formed in the servo pump housing 23 in order to form the pressure limiter 35, and a connecting channel 30 which is connected to the outlet 27 of the servo pump 20 via the housing structure 24 and the supporting structure 13 (FIG. 3) and to the pressure channel 31 leading to the control valve 7 and in which the pressure holding device 28 is formed, can also be seen. Another connecting channel 33 is connected to a relieving channel 32. The relieving channel 32 is connected to the control valve 7. The relieving channel 32 leads from the control valve 7 back into the coolant cycle via the connecting channel 33. In one of its switching positions, the control valve 7 connects the pressure channel 31 to the relieving channel 32, such that only a comparatively low pressure is applied to the piston 15 (FIG. 3) and the setting structure 10 is held in the minimum-overlap adjusting position shown in FIGS. 2 and 3 by the force of the springs 17.

The axial stays 16 which are formed on the internal circumference of the setting structure 10 and released by recesses on the internal circumference which are respectively adjacent in the circumferential direction, wherein said stays ensure a clean axial guide for the setting structure 10, can also be seen in FIG. 5. The setting structure 10 is guided, secured against rotation, relative to the housing 1 of the coolant pump by means of rod-shaped rotational blocks 14 which protrude into corresponding complementary guides on the setting structure 10. One of the rotational blocks 14 can also be seen in FIG. 3. The rotational blocks 14 project axially from the rear side of the supporting structure 13. Lastly, the support points on the setting structure 10 for the springs 17, i.e. the spring seatings 18, can also be seen in FIG. 5.

Figure 6:
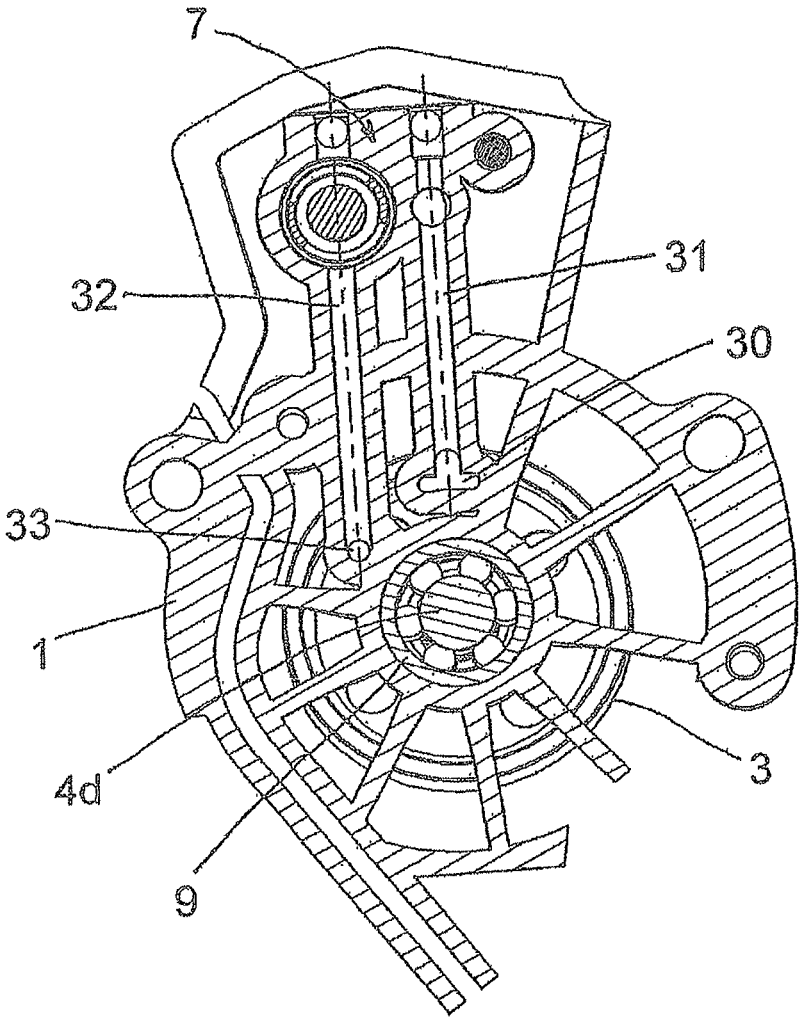
FIG. 6 the pump arrangement in a second cross-section.

FIG. 6 shows the coolant pump again, in another cross-section axially level with the rotary mounting formed in the shaft portion 4*d*. The cross-sectional plane extends along the pressure channel 31 and the relieving channel 32. It should also be added with respect to the rotary mounting that the latter is formed by at least two bearing grooves which are axially spaced from each other and by roll bodies which are arranged in the bearing grooves around the rotational axis R and by a bearing sleeve 9 which encloses the roll bodies on the outside. The bearing grooves are formed directly on the outer circumference of the drive shaft 4. The bearing sleeve 9 is pressed into the housing 1. The drive shaft 4, the roll bearing and/or plurality of roll bearings which are axially spaced from each other and the bearing sleeve 9 together form a design unit which is inserted into the housing 1 when the coolant pump is assembled.

Figure 7:
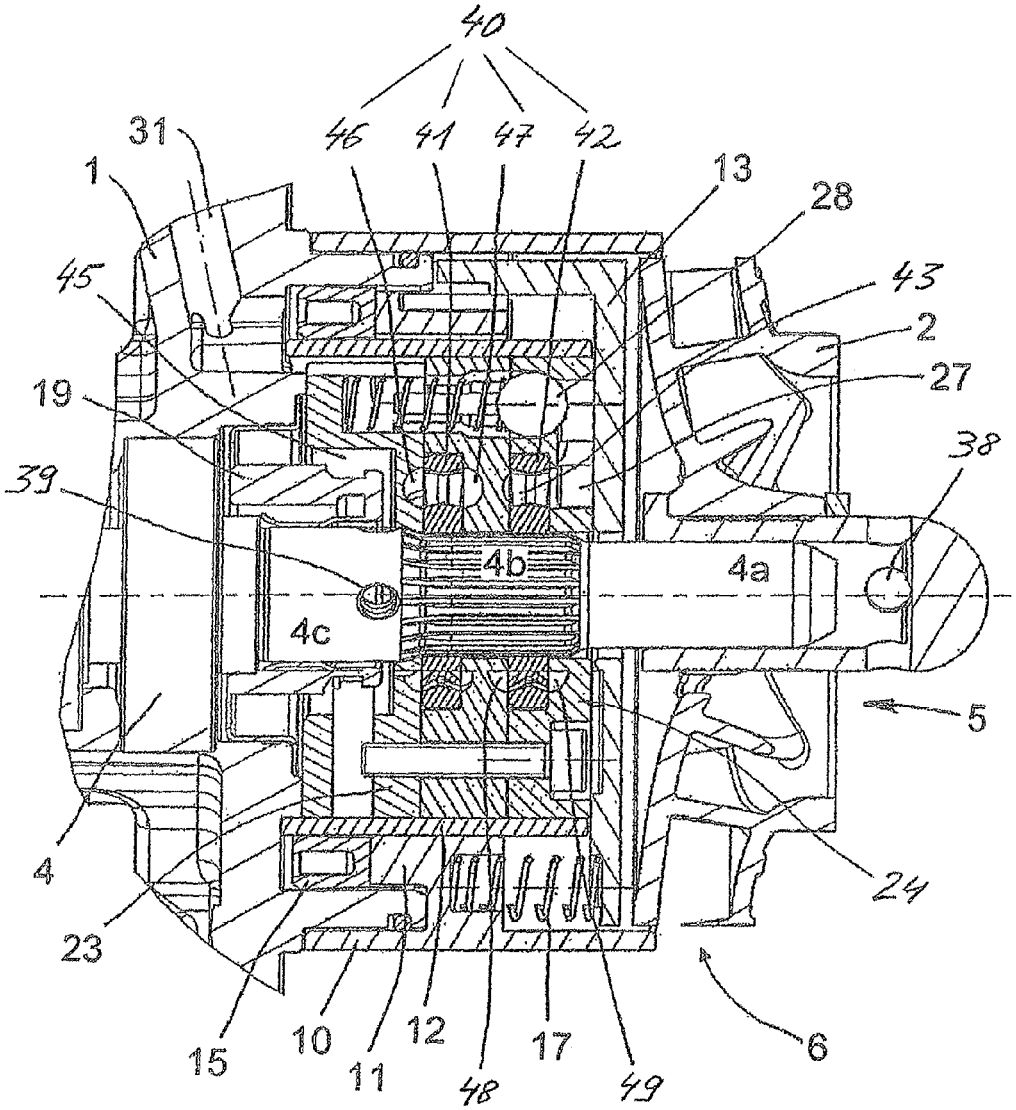
FIG. 7 a pump arrangement comprising a rotary pump which serves as a servo pump, in a second example embodiment.
Figure 8:
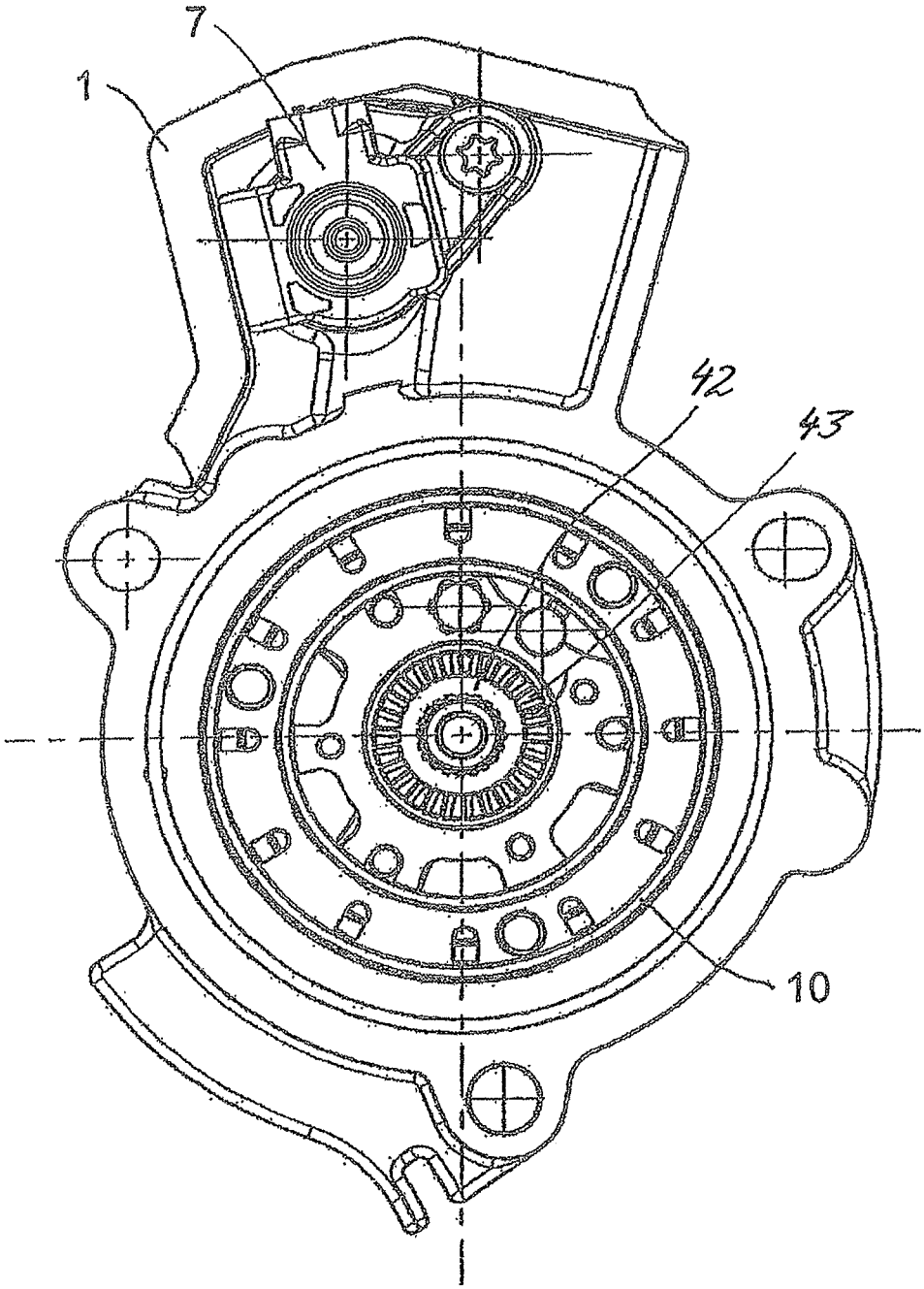
FIG. 8 the pump arrangement of the second example embodiment, in a view onto the servo pump.

FIGS. 7 and 8 show a pump arrangement of a second example embodiment which comprises a rotary-type servo pump 40, which is formed as a side channel pump, instead of the servo pump 20. The servo pump 40 is a multi-stage pump, for example a two-stage pump, wherein the pump stages are connected in series in order to achieve a high delivery pressure. The pump arrangement also differs from the first example embodiment in the way in which the working fluid is fed to the servo pump 40. The pump arrangement can in particular be used as a coolant pump, as in the first example embodiment, and is likewise referred to in the following simply as the coolant pump. When it is used in this way, the working fluid is correspondingly a coolant.

In the centrifugal force field generated by the radial feed wheel 2, the coolant is diverted from the main flow as early as the inflow region 5 of the coolant pump, centrally via a port 38 which is formed there, and guided through the drive shaft 4 to the servo pump 40. The port 38 is formed by at least one inlet opening which ports on the outer circumference of the drive shaft 4. The port 38 is preferably formed jointly by a plurality of inlet openings which are spaced from each other in the circumferential direction. The coolant suctioned by the servo pump 40 flows through the port 38 into and axially through the drive shaft 4 to an outlet 39 which likewise ports on the outer circumference of the drive shaft 4, and flows through the outlet 39 into a fluid space 45 which is connected to an inlet of the servo pump 40 which cannot be seen in the figures. The outlet 39 can also comprise a plurality of such outlet openings. Due to the diversion being central in the centrifugal force field, additionally aided by the fact that the port 38 ports into the centrifugal force field on an outer circumferential area which extends at least substantially axially, only coolant which has been depleted of dirt particles due to the effect of the centrifugal force reaches the servo pump 40.

The servo pump 40 comprises a first servo pump wheel 41 and a second servo pump wheel 42. The pump wheels 41 and 42 are themselves identical, which is expedient but not necessarily required. The pump wheels are cell wheels, each comprising a central region, a circumferential external ring and an annular region which is situated between the central region and the external ring and is sub-divided into axially permeable delivery cells 43 by cell stays, as can be seen from an overview of FIGS. 7 and 8, wherein the delivery cells 43 are separated from each other in the circumferential direction by the cell stays. The servo pump wheels 41 and 42 can also be formed as impellers which are open on the outside, by omitting an external ring which surrounds the delivery cells 43 radially on the outside.

Side channels are formed alongside the servo pump wheels 41 and 42 in the servo pump housing 23, 24 and each extend in the circumferential direction and radially level with the delivery cells 43 over an angle of less than 360°. Thus, a first side channel 46 and a second side channel 47 each extend alongside the first pump wheel 41, one on the left and the other on the right alongside it, and a third side channel 48 and a fourth side channel 49 each extend alongside the second pump wheel 42, one on the left and the other on the right alongside the pump wheel 42. Each of the side channels 46 to 49 is formed in the housing 23, 24 as a recess which is axially open towards the delivery cells 43 of the assigned pump wheel 41 or 42, such that the fluid—in this case, the coolant—can flow back and forth between the delivery cells 43 and the side channels 46, 47 and 48, 49 of the respective pump wheel 41 or 42, in order to achieve the increase in pressure which is known from side channel pumps and is based on impulse transmission in multiple transitions between the delivery cells 43 and the respective side channel. The first side channel 46 is connected to the fluid space 45 via the inlet of the servo pump 40. The second side channel 47 is connected to the third side channel 48, and the fourth side channel is connected to the outlet 28 of the servo pump 40. When rotary-driven, the servo pump 40 suctions the coolant from the fluid space 45 into the side channel 46 via the inlet of the servo pump 40 and thus into the first pump stage formed by the pump wheel 41 and the side channels 46 and 47. The suctioned coolant is delivered at an increased pressure through an internal outlet of the second side channel 47 to an internal inlet of the third side channel 48 and discharged in the second pump stage formed by the pump wheel 42 and the side channels 48 and 49, with a further increase in pressure, through the servo pump outlet 28 towards the pressure holding device 28.

The example embodiment of FIGS. 7 and 8 combines a side channel pump with cleaning the coolant using a centrifugal force. This way of cleaning the coolant can instead also be combined with any other type of servo pump in accordance with the invention, for example the servo pump 20 of the first example embodiment. Instead of cleaning exclusively on the basis of a centrifugal force as in the second example embodiment, any of the arrangements which clean using filter material and consist of a filter or a filter and an assigned cleaning device can equally be combined with a single-stage or multi-stage side channel pump, to mention only some of the possible variations.

Figure 9:
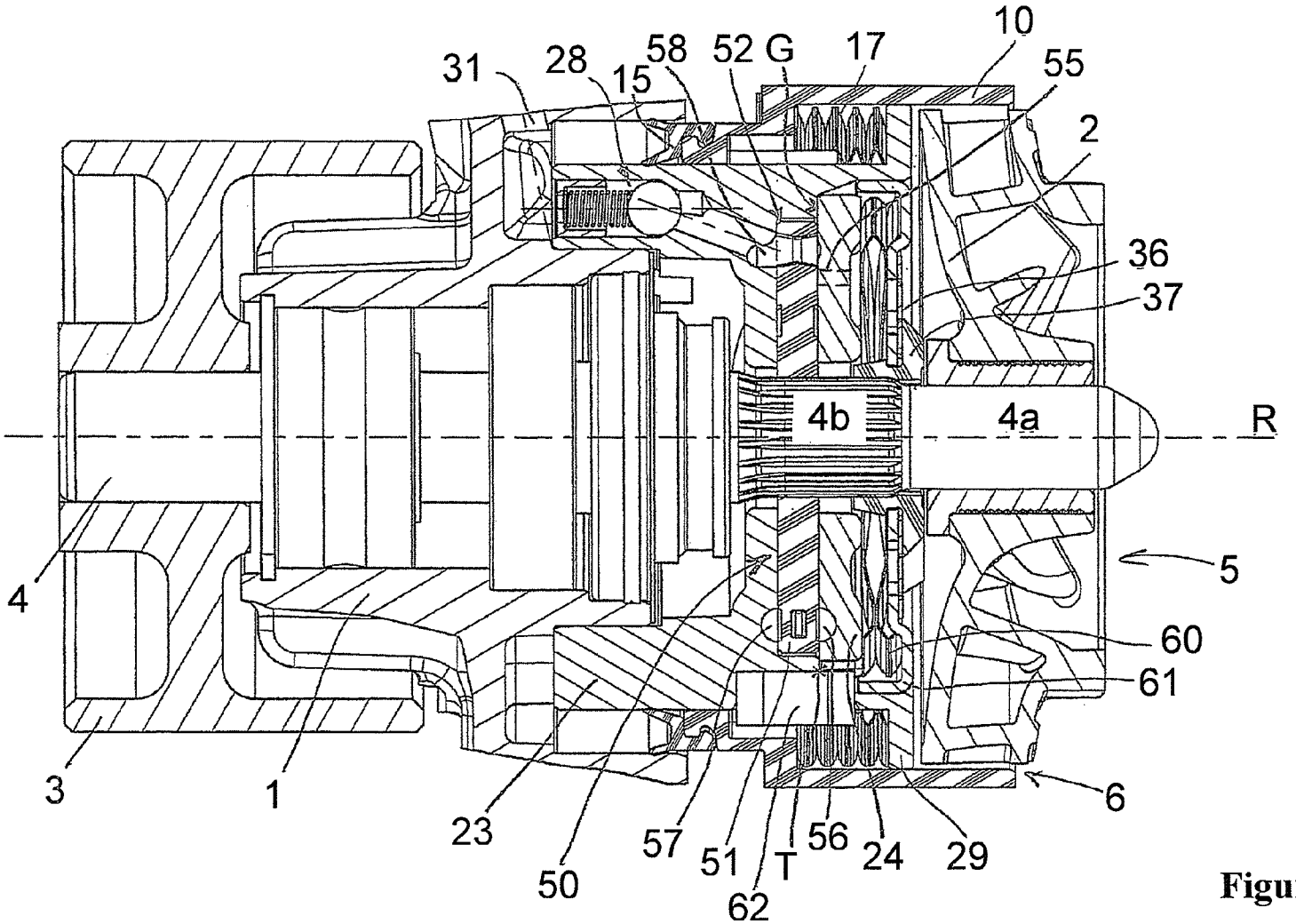
FIG. 9 a pump arrangement comprising a rotary pump which serves as a servo pump, in a third example embodiment.

FIG. 9 shows a pump arrangement which, like the other example embodiments, can in particular be used as a coolant pump. The pump arrangement comprises a radial feed wheel 2 and a setting structure 10 which co-operate in order to adjust the delivery volume of the coolant pump, as described in the other example embodiments. The pump arrangement also comprises a rotary-type servo pump 50 which, as also in the other example embodiments, serves to generate control fluid pressure, required for adjusting the adjusting structure 10, for the control valve 7 (FIGS. 1 and 2) which is not shown in FIG. 9.

The servo pump 50 is a single-stage side channel pump comprising only one servo pump wheel 51 which can correspond to the servo pump wheel 41 of the second example embodiment. The servo pump 50 comprises a servo pump housing comprising the first housing structure 23 and the second housing structure 24. The housing structures 23 and 24 jointly limit a delivery chamber in which the servo pump wheel 51 is accommodated such that it can be rotated about the rotational axis R. As in the other example embodiments, the servo pump wheel 51 is connected, rotationally fixed, to the drive shaft 4 in the shaft portion 4*b* and is thus arranged coaxially with respect to the radial feed wheel 2. Aside from differences in the number of stages, the mode of operation corresponds to that of the second example embodiment. When the pump is rotary-driven, the control fluid—which in the third example embodiment is also formed by the working fluid of the main and/or working pump—is suctioned into a low-pressure region of the delivery chamber 52 via a servo pump inlet 55. The inlet 55 extends through the housing structure 24 and ports in the low-pressure region of the delivery chamber 52 into side channel 56 which is formed on the housing structure 24 facing the servo pump wheel 51. A side channel 57 facing opposite the side channel 56 is formed in the housing structure 23, wherein an outlet 58 ports into the side channel 57 in a high pressure region of the delivery chamber 52, offset in the rotational direction with respect to the inlet 55. A rotational movement of the servo pump wheel 51 delivers the fluid suctioned through the inlet 55 to the outlet 58, with an increase in pressure, by impulse transmission between the delivery cells 53 of the servo pump wheel 51 and the laterally adjoining side channels 56 and 57. The fluid flows from the outlet 58, via the pressure holding device 28 already described, into the pressure channel 31 and the pressure space, connected to it, on the rear side of the piston 15. When the control valve 7 is closed, a corresponding fluid pressure is built up in the pressure space, such that the piston 15 and together with it the setting structure 10 are adjusted into the second adjusting position shown in FIG. 9 and held in the second adjusting position. If the control valve opens, the fluid delivered by the servo pump 50 can flow off and the setting structure 10 is moved towards its first adjusting position by the action of the restoring spring 17.

The delivery volume of the servo pump 50 increases with the rotational speed of the servo pump wheel 51. If the servo pump 50 is to provide a fluid pressure which is sufficient for adjusting the setting structure 10 even at comparatively low rotational speeds of the drive shaft 4, the problem can arise at higher rotational speeds that the servo pump 50 delivers a volume flow which cannot instantaneously flow off when the control valve 7 opens (FIGS. 1 and 2) but rather only gradually. In such situations, the setting structure 10 remains in the second adjusting position—which also corresponds to the minimum delivery volume state of the coolant pump in the third example embodiment—for longer than desired, despite the control valve 7 being open.

In order to resolve the conflict between the desire for the setting structure 10 to be adjustable in the lower rotational speed range and the desire for a short response time in the upper rotational speed range, the servo pump 50 is also adjustable in terms of its delivery volume. In order to be able to adjust the delivery volume, the second housing structure 24 is arranged such that it can be moved back and forth relative to the first housing structure 23 between a first position and a second position. If the housing structure 24 assumes the first position, the delivery chamber 52 is closed off in a fluid seal, aside from the inlet 55, the outlet 58 and unavoidable leaks on the end-facing sides of the pump wheel 51. The first position can therefore also be referred to as a closing position. In the second position, the housing structure 24 is retracted from and/or raised off of the first housing structure 23, such that a gap exists between a first chamber wall formed by the housing structure 23 and a second chamber wall formed by the housing structure 24, wherein fluid can escape from the delivery chamber 52 to the outside through the gap by bypassing the inlet 55 and the outlet 58. In FIG. 9, the second housing structure 24 assumes the first position from which it can be moved towards the second position in order to form the gap. The movement towards the second position can be performed continuously, i.e. in accordance with the pressure in the delivery chamber 52, and the gap width can thus be enlarged continuously. The movement can however instead also be performed abruptly when a particular internal pressure is exceeded. The gap, which does not exist in the first position shown, is indicated by "S".

The housing structure 24 is held in the first position by a pressing force. The pressing force is generated by a pressing device 60 which acts—as is preferred, but merely by way of example—directly on the second housing structure 24. The pressing device 60 is formed by a pressure spring which is embodied as a wave ring spring. A helical spring or disc spring and in principle any other suitable spring could also be used instead of a wave ring spring. It is preferably arranged as a pressure spring. A tension spring could however also for example be provided instead of a pressure spring, in order to press the housing structure 24 into the first position.

The pressing device 60 acts axially on the housing structure 24. The pressing device 60 is axially supported directly on the housing structure 24 and on a supporting structure 61 which faces axially opposite the housing structure 24. It is arranged coaxially with respect to the rotational axis R and circumferentially around the rotational axis R, such that the spring axis coincides with the rotational axis R. The pressing device 60 is preferably arranged with a biasing force between the housing structure 24 and the axially opposite supporting structure 61. If a pressure force which acts on the housing structure 24 due to the fluid pressure in the delivery chamber 52 exceeds the biasing force of the pressing device 60, the housing structure 24 begins to move towards the second position, which reduces the delivery volume of the servo pump 50 at a given rotational speed of the servo pump wheel 51.

In the third example embodiment, the setting structure 10 is axially guided directly by the housing structure 23. The sleeve which is used as the guide 12 in the other example embodiments has been omitted. The piston 15 is arranged such that it can be moved in an annular space which is correspondingly formed directly by the housing 1 of the working pump and the housing structure 23. In order to improve the guide for the setting structure 10 and/or to guide the setting structure 10 more stably, the housing structure 23 comprises a guiding portion 29 which extends up to near the rear side of the radial feed wheel 2 and which additionally also supports the restoring spring 17 which acts on the setting structure 10. The supporting structure 61 is fixedly joined to the housing structure 23 in the region of the guiding portion 29, by means of a pressing connection in the example embodiment.

Unlike the two other example embodiments, the second housing structure 24 also does not serve as a support for the pressure holding device 28. The pressure holding device 28 is accommodated and supported in the first housing structure 23. In one modification, some of the supporting function of the housing structure 23 could be fulfilled by the housing 1 of the working and/or coolant pump. The design of the servo pump 50 is simplified by relieving the movable housing structure 24 of functions with regard to the pressure holding device 28.

In order to adjust the delivery volume of the servo pump 50, the housing structure 24 can be arranged such that it can be moved translationally, in particular axially. It can for example be axially guided on the drive shaft 4. It can however also be axially guided on an internal area of the first housing structure 23 which faces the rotational axis R, in particular a circumferential internal area of the housing structure 23 which is circumferential around the rotational axis R, or instead also on an external area of the housing structure 23 which extends around the rotational axis R, in particular a circumferential external area of the housing structure 23 which is circumferential around the rotational axis R. In the example embodiment, however, the housing structure 24 is preferably arranged such that it can be tilted, i.e. can be tilted away from the housing structure 23 about a tilting axis, forming the gap mentioned.

Figure 10:
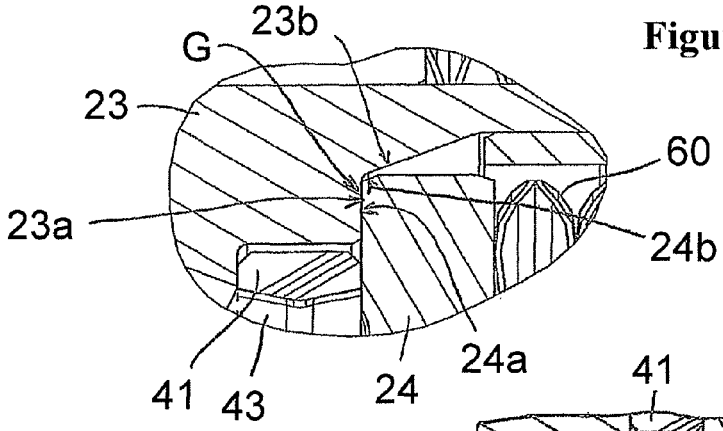
FIG. 10 a first variant of a housing structure of the rotary pump of the third example embodiment, which can be tilted away.
Figure 11:
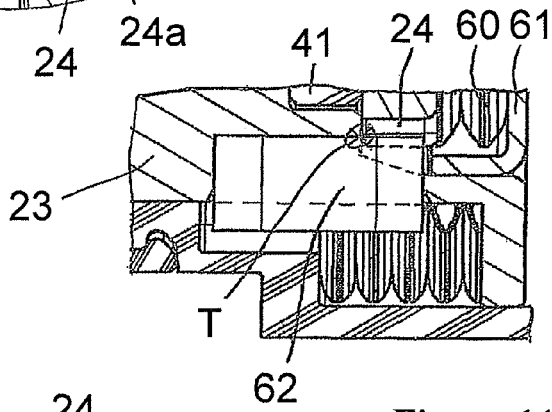
FIG. 11 a supporting region of the housing structure of FIG. 10.

FIGS. 10 and 11 each show a contact region of the housing structures 23 and 24, in an enlarged representation as compared to FIG. 9. FIG. 11 shows the supporting region in which the housing structure 24 is supported on the first housing structure 23, forming the tilting axis T, when it is tilted away, i.e. when it assumes the second position. FIG. 10 shows the region which is opposite across the rotational axis R and in which the housing structure 24 is raised off of the housing structure 23, forming the gap G, when it is moved from the first position, which is still shown in FIGS. 10 and 11, towards the second position. In the first position shown in FIGS. 9 to 11, an end-facing area 24*a* of the housing structure 24 abuts an end-facing area 23*a* of the housing structure 23 which faces it, in a seal circumferentially around the rotational axis R, and is pressed into a pressure contact, in a seal circumferentially around the rotational axis R, by the pressing device 60.

The housing structure 24 is connected, such that it cannot be rotationally moved about the rotational axis R, to the housing structure 23, so that the position of the inlet 55, which leads through the housing structure 24, cannot be altered in the circumferential direction during the adjusting movements of the housing structure 24. For this purpose, the housing structure 24 is guided, within the bounds of its mobility, by means of a guide 62. The guide 62 extends axially and is preferably joined fixedly to the housing structure 23. In the example embodiment, a parallel key forms the guide 62. In a supporting region which includes the tilting axis T, the guide 62 protrudes axially inwards towards the rotational axis R. The supporting region of the housing structure 24 comprises a cavity, for example a narrow, axially extending gap, with which the guide 62 engages in the guiding engagement with the housing structure 24. The guide 62 co-operates with the housing structure 24 in the manner of a tongue-and-groove guide, wherein the geometry could also be reversed, in that the "tongue" could be provided on the housing structure 24 and the "groove" on the housing structure 23. In any event, the housing structure 24 is secured in terms of its rotational angular position relative to the housing structure 23 in the guiding engagement by means of the guide 62, and the mobility required for adjusting the delivery volume is enabled.

One advantage of the housing structure 24 being able to tilt, as compared to being able to move axially, is that the danger of the housing structure 24 twisting and therefore jamming can be avoided or at least reduced. If it is able to move axially, a certain danger would exist in this respect because of the required axial guide. The pressure force exerted on the housing structure 24 by the working fluid acts on the housing structure 24, i.e. with an eccentricity with respect to the rotational axis R, such that for a tilt-free axial guide, the pressing force would likewise have to correspondingly act on the housing structure 24 eccentrically rather than concentrically with respect to the rotational axis R. An ability to tilt does not however cause a danger of twisting.

In the example embodiment, a circumferential internal area 23*b* of the housing structure 23 surrounds the housing structure 24. The circumferential internal area 23*b* does not however fulfil any mounting or guiding function for the housing structure 24. As already described, the housing structure 24 is instead supported only on the end-facing area 23*a* of the housing structure 23 which faces it. Because of the conditions of restricted space, the circumferential internal area 23*b* lies opposite a circumferential external area 24*b* of the housing structure 24 at a very small distance. In order to further reduce the danger of twisting, the circumferential external area 24*b* of the housing structure 24 is circumferentially provided with a chamfer, as can be seen in FIG. 10, such that the circumferential external area 24*b* transitions into the end-facing area 24*a* via the chamfer. The clearance provided by the chamfer is sufficient to enable the required short-stroke tilting movement within the bounds of usual gap tolerances, without twisting.

Figure 12:
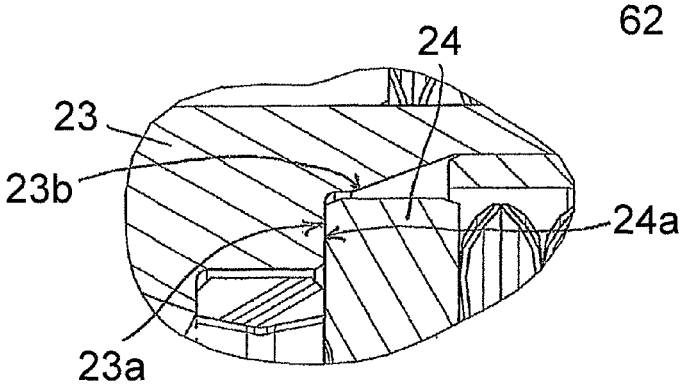
FIG. 12 a second variant of a housing structure of the rotary pump of the third example embodiment, which can be tilted away.

FIG. 12 shows the tilting region of FIG. 10, with a modification which is that the housing structure 23 initially comprises a short hollow-cylindrical portion directly following the end-facing area 23*a*, which is then followed by a widened portion as in FIGS. 9 to 11.

Figure 14:
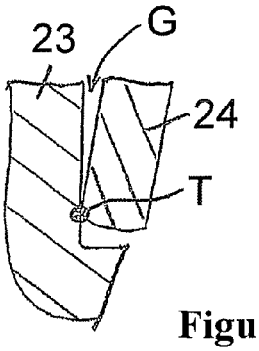
FIG. 14 the supporting region of the housing structure of FIG. 13.
Figure 13:
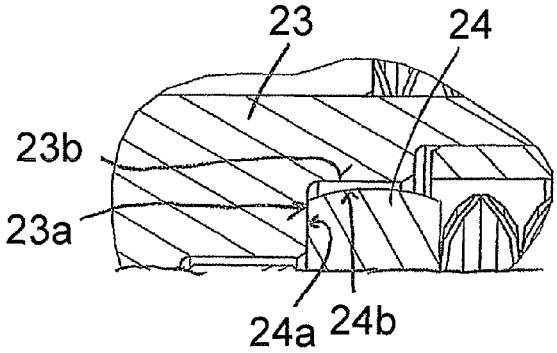
FIG. 13 a third variant of a housing structure of the rotary pump of the third example embodiment, which can be tilted away.

FIG. 13 shows the tilting region again, in another modification in which on the one hand the circumferential internal area 23*b* which lies radially opposite the housing structure 24 is formed cylindrically over almost the axial length of the housing structure 24, and on the other hand, the housing structure 24 is formed convexly at its circumferential external area. The supporting region for this variant is shown in FIG. 14, with the housing structure 24 in the second position, i.e. the position tilted away. The gap G is drawn with an exaggerated width, merely for the purposes of illustration; it is actually sufficient if the gap G in the second position measures only a tenth or a few tenths of a millimeter or even less than a tenth of a millimeter in the tilting region which lies opposite the tilting axis T as viewed across the rotational axis R.

It should also be added with respect to the third example embodiment that the pump arrangement comprises a filter device, which is again modified, for cleaning the working fluid which flows to the servo pump 50. The filter device comprises a stationary filter 36 which is arranged on the supporting structure 61 and is for example joined by being adhered or fused. Unlike the coolant pump of FIGS. 1 to 6, however, the filter 36 is assigned a cleaning device 37 which mechanically cleans the filter 36 when the drive shaft 4 rotates.

The cleaning device 37 is formed by a scraper which is connected, such that it cannot be rotated, to the drive shaft 4 and arranged upstream, i.e. in front of the filter 36, as viewed in the direction of flow to the servo pump 50. The cleaning device 37 is slid onto the drive shaft 4, into a positive-fit engagement with the shaft portion 4*b*, which provides the rotationally fixed connection. When the drive shaft 4 rotates, the cleaning device 37 sweeps over the front side of the filter 36 which faces it and scrapes off dirt particles during this relative rotation. The cleaning device 37 is formed—as is preferred, but merely by way of example—as an impeller comprising a plurality of projecting vanes. Each of the vanes can act as a scraper. In modifications, the filter 36 can be mechanically cleaned using a cleaning device which acts as a brush instead of the scraping cleaning device 37, or by a combination of scraping and brushing, for example by either forming the vanes as brushes or by forming at least one of the vanes as a brush and at least one of the other vanes as a scraper. The scraping action can be performed either purely mechanically, i.e. only through contact, or purely fluidically or also mechanically and fluidically. There is preferably no direct contact between the scraper and/or cleaning device 37 and the facing surface of the filter, but rather a small distance. The cleaning device 37 thus sweeps over the facing surface of the filter at a very small distance and can only then have contact with adhering dirt particles and so sweep them off the surface of the filter, wherein the distance from the surface of the filter would be within the size range of the dirt particles. The scraping action can also be fluidic, in that the relative rotational movement of the cleaning device 37 generates a rotating flow on the facing surface of the filter, and the adhering dirt particles are taken up by this flow, i.e. fluidically, and removed from the surface of the filter either in this way alone or additionally due to particle contact.

Aside from the differences described, the pump arrangement of the third example embodiment corresponds to that of the first example embodiment.

In the first example embodiment (FIGS. 1 to 6), the housing structure 24 can likewise be arranged such that it can be moved between a first position and a second position, in order to be able to adjust the delivery volume of the servo pump 20 as described on the basis of the third example embodiment. The housing structure 24 of the first example embodiment can in particular, like the housing structure 24 of the third example embodiment, be mounted such that it can be tilted, against a pressing force. However, a pressing device corresponding to the pressing device 60 must likewise be arranged between the housing structure 24 and the supporting structure 13 (FIG. 3 for example). It would also be advantageous if the pressure holding device 28 of the first example embodiment is axially supported directly on the housing structure 23 rather than on the housing structure 24. A certain disadvantage is also presented by the fact that the outlet 27 leads through the housing structure 24 of the first example embodiment, which can require the arrangement of a flexible fluid connection. In order to circumvent this, the housing structure 24 can be assembled from at least two partial structures, i.e. a first partial structure through which the outlet 27 extends and which can also support the pressure holding device 28, and a second partial structure which can be moved relative to the first partial structure and the first housing structure 23 and which forms the second housing structure of the claims in such modifications.

The servo pump 40 of the second example embodiment can also be modified in the way described with respect to the first example embodiment, in order to be able to adjust the servo pump 40 in terms of its delivery volume.

In yet other modifications, a movable housing structure can be provided on the end-facing wall of the housing structure 23 which lies axially opposite the respective housing structure 24 in the embodiments of FIGS. 1 to 8, where it can form the end-facing wall of the delivery chamber or a part of the end-facing wall of the respective delivery chamber and can be able to be moved as described on the basis of the movable housing structure 24.

If the servo pump 20, 40 or 50 is adjustable in terms of its delivery volume, it is for example possible to omit the pressure limiter 35 (FIG. 4) described with respect to the first example embodiment. In principle, however, such a pressure limiter 35 can also be provided in a servo pump 20, 40 or 50 which is adjustable in terms of its delivery volume.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

REFERENCE SIGNS

1 housing
2 radial feed wheel
3 drive wheel
4 drive shaft
4*a-e* shaft portions
5 inflow region
6 outflow region
7 control valve
8 port
9 bearing sleeve
10 setting structure, annular slider
11 housing support
12 guide, guiding sleeve
13 supporting structure, cover
14 rotational block
15 piston, seal
16 guiding stay
17 restoring spring
18 spring seating, spring guide
19 seal
20 servo pump
21 servo pump wheel, internal wheel
22 servo pump wheel, external wheel
23 servo pump housing, housing structure
23*a* end-facing area
23*b* internal area
23*b* housing structure, housing cover
24*a* end-facing area
24*b* external area
25 inlet
26 filter
27 outlet
28 pressure holding device
29 guide
30 connecting channel
31 pressure channel
32 relieving channel
33 connecting channel
34 -
35 pressure limiter
36 filter
37 cleaning device
38 port, inlet
39 outlet
40 servo pump
41 servo pump wheel, cell wheel
42 servo pump wheel, cell wheel
43 delivery cells
44 -
45 fluid space
46 side channel
47 side channel
48 side channel
49 side channel
50 servo pump
51 servo pump wheel, cell wheel
52 delivery chamber
53 delivery cells
54 -
55 inlet
56 side channel
57 side channel
58 outlet
59 -
60 pressing device
61 supporting structure
62 guide
T tilting axis
R rotational axis
G gap

The invention claimed is:

1. A rotary pump exhibiting an adjustable delivery volume, comprising:

a housing including a first housing structure and a second housing structure;

a delivery chamber comprising a first chamber wall formed by the first housing structure, a second chamber wall formed by the second housing structure, an inlet for a fluid in a low-pressure region and an outlet for the fluid in a high pressure region;

a pump wheel which can be rotated in the delivery chamber about a rotational axis (R); and a pressing device for generating a pressing force, wherein the second housing structure can be moved relative to the first housing structure from a first position into a second position, against the pressing force, and in the second position, a gap (G) exists between the first chamber wall and the second chamber wall, wherein fluid can escape from the delivery chamber by bypassing the inlet and the outlet, and wherein in the first position, the second housing structure abuts the first housing structure and forms a seal therewith.

2. The rotary pump according to claim 1, wherein the second chamber wall is an end-facing wall or a region of an end-facing wall of the delivery chamber.

3. The rotary pump according to claim 1, wherein the second housing structure is a housing cover which closes off the delivery chamber on one end-facing side.

4. The rotary pump according to claim 1, wherein the second chamber wall limits the low-pressure region.

5. The rotary pump according to claim 4, wherein the inlet ports into the delivery chamber in the second chamber wall.

6. The rotary pump according to claim 1, wherein the second housing structure can be tilted or pivoted relative to the first housing structure into the open position.

7. The rotary pump according to claim 6, wherein a tilting or pivoting axis (T) of the second housing structure extends transverse to the rotational axis (R).

8. The rotary pump according to claim 7, wherein the tilting or pivoting axis (T) of the second housing structure extends in the vicinity of the guide or through the guide.

9. The rotary pump according to claim 1, wherein the pressing device presses the second housing structure against the first housing structure in the axial direction.

10. The rotary pump according to claim 1, wherein the first housing structure comprises an end-facing area on a side which axially faces the second housing structure, and either an internal area which points towards the rotational axis (R) and forms an internal angle with the end-facing area or an external area which points away from the rotational axis (R) and forms an external angle with the end-facing area, and wherein the second housing structure abuts the end-facing area or either the internal area or the external area and can be tilted into the second position about a tilting axis (T) formed in the pressure contact.

11. The rotary pump according to claim 1, wherein the second housing structure is guided, such that it cannot be rotated about the rotational axis (R), relative to the first housing structure.

12. The rotary pump according to claim 11, wherein the second housing structure is guided by an axial guide which is joined to the first housing structure in a positive fit, a frictional fit or a material fit and formed on the first housing structure.

13. The rotary pump according to claim 12, wherein the tilting or pivoting axis (T) of the second housing structure (24) extends in the vicinity of the guide or through the guide.

14. The rotary pump according to claim 13, wherein the tilting or pivoting axis extends transverse to a guiding device of the guide.

15. The rotary pump according to claim 1, wherein the rotary pump comprises one or more side channel stages.

16. The rotary pump according to claim 1, wherein the rotary pump is a side channel pump.

17. The rotary pump according to claim 1, wherein the pressing device comprises or is formed by a mechanical spring.

18. The rotary pump according to claim 17, wherein the spring is a wave ring spring, a helical spring, a disc spring or a leaf spring.

19. The rotary pump according to claim 17, wherein the spring is pressurised.

20. A pump arrangement for supplying a unit, wherein the pump arrangement comprises a working pump for conveying the working fluid towards or away from the unit, and a rotary pump according to claim 1, wherein the working pump comprises:

a working pump housing;

a drive shaft for rotary-driving the working pump, by the combustion engine and in a fixed rotational speed relationship to it;

a working pump wheel, which can be rotary-driven by the drive shaft and is connected, rotationally fixed, to the drive shaft, for conveying the working fluid;

a setting structure which can be adjusted into different positions relative to the working pump housing by a control fluid, in order to adjust a working pump configuration which influences the delivery volume of the working pump at a given rotational speed; and a control valve for setting a pressure or volume flow of the control fluid formed by the working fluid, which determines the position of the setting structure, and wherein the rotary pump is provided for delivering the control fluid to the control valve and is preferably arranged at least partially in the working pump housing.

21. The pump arrangement according to claim 20, wherein the pump wheel of the rotary pump can be rotary-driven by the drive shaft.

22. The arrangement according to claim 21, wherein the pump wheel is connected, rotationally fixed, to the drive shaft.

23. The pump arrangement according to claim 20, wherein the working pump wheel is a radial feed wheel for conveying the working fluid from a radially internal inflow region into a radially more external outflow region and in that the pump configuration which can be adjusted by the setting structure is an adjustable flow geometry.

24. The pump arrangement according to claim 23, wherein the adjustable flow geometry is a fluid cross-section or flow profile on the flow path of the working fluid which comprises the inflow region, the working pump wheel and the outflow region.

25. The pump arrangement according to claim 20, wherein the pump arrangement is a coolant pump for a combustion engine.

26. The pump arrangement according to claim 20, wherein the pump arrangement supplies a unit of a combustion engine with the working fluid.

* * * * *